United States Patent [19]

Black

[11] 4,435,008

[45] Mar. 6, 1984

[54] POLICE GRIPPER

[76] Inventor: William R. Black, Rte. 2, Halderson Rd., Bangor, Wis. 54614

[21] Appl. No.: 383,000

[22] Filed: May 28, 1982

[51] Int. Cl.[3] ..... A47G 35/00

[52] U.S. Cl. ..... 294/25

[58] Field of Search ..... 294/25, 1 R, 26; 2/16, 2/20, 158, 159, 21, 160, 161 R, 161 A; 273/166, 54, 63

[56] References Cited

U.S. PATENT DOCUMENTS 1,836,223 12/1931 Burns et al. ..... 294/25

3,178,724 4/1965 Perschke ..... 294/25

3,208,749 9/1965 Skase ..... 294/25

*Primary Examiner*—James B. Marbert

*Attorney, Agent, or Firm*—Henry C. Fuller

[57] ABSTRACT

A device to aid law enforcement officers to handle suspects or captives includes a strap with a loop which is connected at one end to the officer's finger and a wrist band portion which is wrapped around the wrist and fastened to a gripping portion which is provided with a series of protrusions which engage and cause discomfort to the suspect or captive when the officer grips the captive about the wrist, arm or leg.

2 Claims, 3 Drawing Figures

POLICE GRIPPER

BACKGROUND OF THE INVENTION

The present invention relates to a gripping device intended to enhance the grip of a law enforcement officer on the arm or wrist of a captive without bruising, pinching or cutting the flesh of the captive. Heretofore, small chains with twist handles have been employed to manipulate captives. These devices can cause injury to the captive.

SUMMARY OF THE INVENTION

The invention provides a gripping device in the form of a strap which is worn on the hand of the officer and which has a loop to anchor one end to the finger of the user. The loop is adjacent a gripping portion which has a plurality of snap fasteners having exaggerated protrusions which are intended to engage and cause discomfort to a captive. A wrist band portion has one or more snap fasteners which afford adjustment of the length of the wrist band to provide a snug fit on the hand of the user. The snap fasteners on the wrist band portion couple with the female members of the snap fasteners on the side of the strap opposite the gripping portion to secure the device to the officer's wrist.

The device of the invention can be worn whenever the possibility of a physical encounter is apparent. The officer merely grips the wrist, hand or thumb of the captive and by applying basic police grips obtains good control of the suspect or captive and the captive can be moved easily without resistance to minimize threat of harm to the officer and minimize or eliminate harm to the captive.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
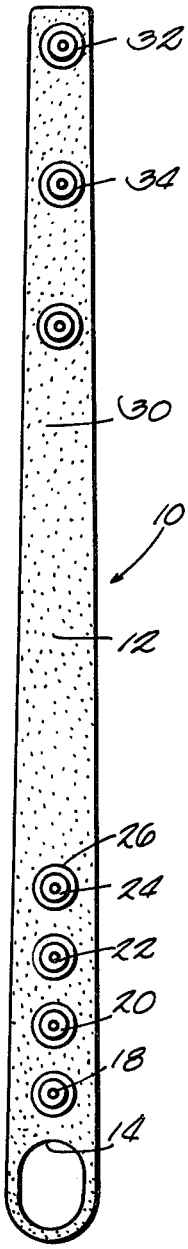
FIG. 1 is a top view of the gripping device of the invention.
Figure 2:
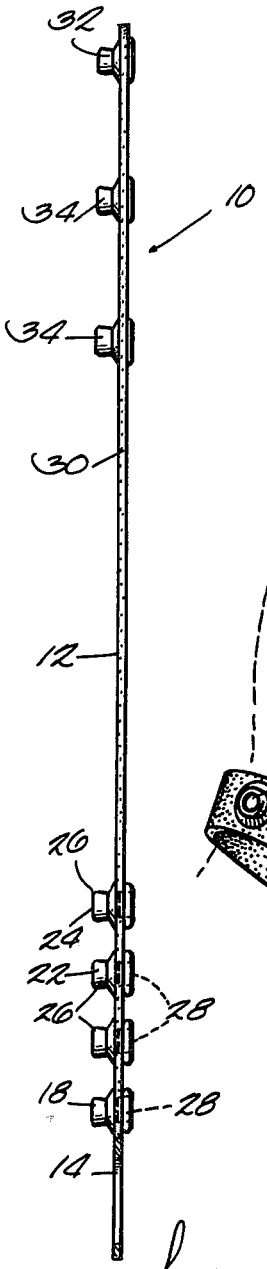
FIG. 2 is a side view of the device shown in FIG. 1.
Figure 3:
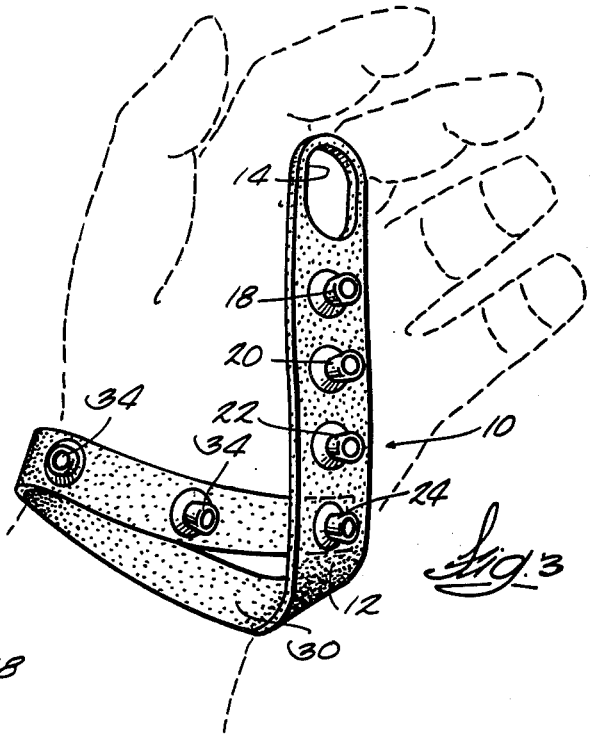
FIG. 3 is a perspective view of the device shown arranged around the hand of a user.

The device 10 includes a strap 12 which is flexible and can be formed from leather or plastic or other suitable flexbile material. Desirably the strap has sufficient flexibility to conform to the hand of the user, as illustrated in FIG. 3). The strap has a loop or finger opening 14 at one end which is adapted to receive a finger of the officer's hand. Adjacent the loop 14 is a plurality of gripping elements 18, 20, 22 and 24 which face outwardly from the officer's hand. In the disclosed construction, the gripping elements comprise snap fasteners with an exaggerated male component or member 26 on the front side of the strap, and a female receptacle member 28 on the back of the strap. The gripping elements are spaced to span the palm of the hand of the officer for engagement with the wrist of the captive at spaced points around the periphery of the wrist.

The device also includes a wrist band portion 30 which includes one or more snap fasteners 32, 34 which have a male member which couple with one of the female members 28 of the fasteners 18, 20, 22, 24 to secure the device 10 to the hand of the officer. The use of more than one wrist fastener affords adjustment of the length of the wrist band portion to accommodate the hand size and wrist of the officer.

The fasteners enable snapping the device over the belt of the officer when the device is not in use. No special holder is required. The enhanced grip of the officer, together with the discomfort to the suspect or captive enable the officer to easily remove a person from an auto or chair and lift from a floor or for escort purposes. It also can be used when frisking or handcuffing.

I claim:

1. A device for improving the grip of a law enforcement officer to facilitate the handling of captives comprising a flexible strap which conforms to the hand of the officer, said strap having a loop at one end thereof to be received by the finger of the officer to anchor one end of said strap and a gripping portion containing a plurality of spaced gripping elements and a wrist band portion adapted to be trained around the wrist of the officer, and means for coupling the wrist band portion to said grip portion when said portions intersect over the palm of said user to secure the device in the officer's hand with the grip portion juxtaposed over the palm of the officer's hand, and the gripping elements projecting outwardly from the palm and with the gripping elements exposed for engagement and wherein said gripping elements comprise snap fasteners having protruding male members on one side of said strap and exposed female members on the opposite side of said strap, with said male members forming the gripping elements and the female counterparts of said male members joinable at said intersection with the protruding male members on said wrist band portion when said wrist portion and said grip portion are in intersecting and in overlapping relation on the palm of the user to form a strap loop around the wrist of the user to hold the strap in place.

2. The device of claim 1 wherein said male members which form said gripping elements have a greater projection from the strap than the male members of the wrist band fasteners.

* * * * *